US012497766B2

(12) United States Patent
Hu et al.

(10) Patent No.: US 12,497,766 B2
(45) Date of Patent: Dec. 16, 2025

(54) WATER SUPPLY SHOWER BODY AND ITS APPLICATION

(71) Applicant: Clement Inc., Flushing, NY (US)

(72) Inventors: Yunan Hu, Ganzhou (CN); Chunhua Wang, Xiamen (CN); Changzheng Ni, Xiamen (CN); Yongqiang Yan, Fuzhou (CN)

(73) Assignee: CLEMENT INC., Flushing, NY (US)

( * ) Notice: Subject to any disclaimer, the term of this patent is extended or adjusted under 35 U.S.C. 154(b) by 141 days.

(21) Appl. No.: 18/519,819

(22) Filed: Nov. 27, 2023

(65) Prior Publication Data

US 2025/0059740 A1 Feb. 20, 2025

(30) Foreign Application Priority Data

Aug. 29, 2023 (CN) ..... 202311092805.9
Aug. 29, 2023 (CN) ..... 202322319860.9

(51) Int. Cl.
*E03C 1/04* (2006.01)
*E03C 1/02* (2006.01)

(52) U.S. Cl.
CPC ..... *E03C 1/0408* (2013.01); *E03C 1/025* (2013.01); *E03C 1/023* (2013.01)

(58) Field of Classification Search
CPC ..... E03C 1/0408; E03C 1/025; E03C 1/042; E03C 1/0404; E03C 1/02; E03C 1/021; E03C 1/023
USPC ..... 4/601, 605, 612, 615, 675
See application file for complete search history.

(56) References Cited

U.S. PATENT DOCUMENTS 8,429,769 B2 * 4/2013 Gross ..... E03C 1/06 4/601
11,920,691 B2 * 3/2024 Pfund ..... F16K 27/003

* cited by examiner

*Primary Examiner* — David J Walczak

(57) ABSTRACT

A water supply shower body includes a five-way water distribution base, an installation base, a water inlet base, a first switch valve assembly, and a second switch valve assembly. The five-way water distribution base comprises a water inlet, a first water outlet, a first installation port, a second water outlet, and a second installation port. The first installation port and the second installation port communicate with the water inlet, and the first installation port and the second installation port respectively communicate with the first water outlet and the second water outlet. One end of the water inlet base comprises a water outlet end connected to the water inlet, and another end of the water inlet base comprises a water inlet end.

16 Claims, 17 Drawing Sheets

WATER SUPPLY SHOWER BODY AND ITS APPLICATION

TECHNICAL FIELD

The present disclosure relates to bathroom products, and in particular to a water supply shower body and its application.

BACKGROUND

Traditional shower bodies are generally used in conjunction with top sprays. At present, there are also some designs on the market where the shower body is connected to both the top spray and a sprinkler, and a switch corresponding to releasing water from the top spray and releasing water from the sprinkler is disposed. The switch is generally controlled by a knob, such as rotating up to release water from the top spray, rotating down to release water from the sprinkler, and continuing to rotate to simultaneously release water from the top spray and the sprinkler. Although this operation method and structure have the advantage of compact structure, there is a high probability of operation errors, which brings a bad user experience.

SUMMARY OF THE DISCLOSURE

The present disclosure provides a shower structure that is simple and convenient to use to solve the above technical problems.

In a first aspect, a water supply shower body is provided. The water supply shower body includes a five-way water distribution base, an installation base, a water inlet base, a first switch valve assembly, and a second switch valve assembly.

The five-way water distribution base is provided with five ports, namely a water inlet, a first water outlet, a first installation port, a second water outlet, and a second installation port; and both the first installation port and the second installation port are communicated with the water inlet, and the first installation port and the second installation port are respectively communicated with the first water outlet and the second water outlet.

The five-way water distribution base is installed inside the installation base; and the installation base is provided with five openings that correspond to the five ports of the five-way water distribution base.

One end of the water inlet base is installed on the installation base and is provided with a water outlet end that is connected to the water inlet, and the other end of the water inlet base is provided with a water inlet end, which is able to supply water to the five-way water distribution base.

The first switch valve assembly is installed in the first installation port, and the water inlet and the first water outlet are connected/disconnected through the first switch valve assembly; and the second switch valve assembly is installed in the second installation port, and the water inlet and second water outlet are connected/disconnected through the second switch valve assembly.

When in use, a user may open/close the first water outlet through the first switch valve assembly, and may open/close the second water outlet through the second switch valve assembly. In addition, the switches of the two water outlets may be operated independently. That is, the switches of the two water outlets may be opened simultaneously, individually, or simultaneously.

In the present disclosure, the five-way water distribution base is disposed, to achieve the independent setting of control switches for two water outlets, thereby avoiding inconvenience to the user when four gears are concentrated on one switch.

In some embodiments, the water inlet end of the water inlet base adopts a support arm structure, the support arm is tilted upwards, and an end of the support arm is horizontally arranged to connect with the outlet pipe on the wall.

In some embodiments, an outer circumference of the water inlet of the five-way water distribution base is provided with two symmetrical strip holes, and the two strip holes are perpendicular to an axial direction of the water inlet; the water outlet end of the water inlet base is inserted into the water inlet of the five-way water distribution base, and two strip grooves are arranged corresponding to the two strip holes; and a U-shaped fastener is sleeved on the outer circumference of the water inlet of the five-way water distribution base, and two ends of the U-shaped fastener are respectively clamped into the two strip grooves through the strip holes.

In some embodiments, the installation base is shell shaped and covers the water outlet end of the water inlet base and the five-way water distribution base.

In some embodiments, each of the first switch valve assembly and a second switch valve assembly adopts a press switch structure which is easy to use.

In some embodiments, the first switch valve assembly comprises a first button valve core and a first button, the first button valve core is installed in the first installation port, one end of the first button is connected to the button valve core, and the other end of the first button extends out of the installation base; and the second switch valve assembly comprises a second button valve core and a second button, the second button valve core is installed in the second installation port, one end of the second button is connected to the button valve core, and the other end of the second button extends out of the installation base.

In some embodiments, a first water inlet hole is defined between the first installation port and the water inlet, and a first water outlet hole is defined between the first installation port and the first water outlet; and a second water inlet hole is defined between the second installation port and the water inlet, and a second water outlet hole is defined between the second installation port and the second water outlet.

In some embodiments, the water inlet is located on a back of the five-way water distribution base, and the first water outlet and the second water outlet are respectively located on an upper end and a lower end of the five-way water distribution base; and the first installation port and the second installation port are respectively located on two sides of the five-way water distribution base.

In some embodiments, the first water outlet is connected to a top spray, and the second water outlet is connected to a sprinkler.

In a second aspect, a shower is provided. The shower includes a water outlet element and a water supply shower body in the first aspect. The water outlet element is provided with at least two water outlet channels and corresponding at least two water outlet holes, the water outlet element is provided with a rotary switching joint, the water outlet element is rotatably installed at the first water outlet of the water supply shower body through the rotary switching joint, and the first water outlet is communicated with any one of the at least two water outlet channels and the at least two water outlet holes through the rotary switching joint.

When in use, by rotating the water outlet element, it is possible to drive the relative rotation between the rotary switching joint and the water outlet channel, thereby achieving changes in the switching water path and water outlet status, which is convenient to use and brings a different user experience.

In some embodiments, the water outlet element is provided with an installation groove, and a bottom of the installation groove is provided with a plurality of water distribution hole that is communicated with a plurality of water inlet channels one by one; the rotary switching joint is provided with a water distribution body, and the water distribution body is provided with a water outlet passage; and the water distribution body is rotatably installed in the installation groove, and the other end is fixedly installed relative to the first water outlet of the water supply shower body.

In some embodiments, in order to improve the flexibility of the water outlet element and make it more suitable for the users of various heights, the rotary switching joint further comprises a swing joint, a connecting channel is defined in an internal of the swing joint and is communicated with the water outlet passage and the first water outlet, and a swing axis of the swing joint is perpendicular to a rotation axis of the water distribution body. Thus, the water outlet element may swing up and down through the swing joint without affecting the rotation switching function.

In some embodiments, the swing joint is a ball head with a pin hole, the connecting channel is communicated with the ball head, and the pin hole is perpendicular to the rotation axis of the water distribution body; the rotary switching joint further comprises a fixing nut and a pin; and the water distribution body is installed in the installation groove through screw rotation; a water inlet end of the water distribution body is provided with a bowl-shaped groove, and two symmetrical notches are arranged on two sides of the bowl-shaped groove; the fixing nut presses and installs the ball head on the bowl-shaped groove; the pin penetrates the ball head through the pin hole, and two ends of the pin rotate and snap into a gap; and the water inlet end of the ball head is connected to the first water outlet of the water supply shower body through a connecting rod.

In some embodiments, the at least two water outlet channels and the at least two water outlet holes have four groups, which are respectively located on four surfaces of the water outlet element. That is, the water outlet element has four types of outlet water sprays.

In a third aspect, a water supply shower is provided. The water supply shower includes the water supply shower body in the first aspect. The water inlet base is provided with a water outlet groove, and the water outlet groove is respectively communicated with the water inlet end and water outlet end through a water supply hole and a drainage hole: and an opening of the water outlet groove is installed with a plug or a filter, and a filtering channel of the filter is respectively connected to the water supply hole and the drainage hole. That is, the plug and filter may be replaced, thereby achieving that the water supply shower may use the filter to filter water or not.

In some embodiments, the plug or the filter is assembled with the water outlet groove by using a staggered rotating structure, the head circumference of the plug or the filter is provided with a rotating docking convex block, an opening circumference of the water outlet groove is provided with a circular rotating docking groove, and a side of the rotating docking convex block and a starting wall surface of the rotating docking groove are provided with corresponding guiding slopes for convenient docking operations.

From the above description of the present disclosure, it may be seen that the present disclosure has the following beneficial effects.

First, the five-way water distribution base is disposed, to achieve the independent setting of control switches for two water outlets, thereby avoiding inconvenience to the user when four gears are concentrated on one switch.

Second, the five-way water distribution base may achieve the required independent control of the water outlet effect, and the structure is simple and may be formed by one-time molding.

Third, the water outlet element with the rotating switch joint is disposed, the user may obtain the desired water outlet mode by rotating the direction of the water outlet element, which is convenient to use and not prone to confusion in operation.

Fourth, the rotary switching joint is provided with the swing joint, and the water outlet element may swing up and down through the swing joint without affecting the rotation switch function. It has high flexibility and is more suitable for users of various heights.

Fifth, the water outlet groove is disposed on the water inlet base, which may be matched with the plug or the filter, thereby achieving that the water supply shower may use the filter to filter water or not.

Sixth, the plug or the filter is assembled with the water outlet groove by using the staggered rotating structure, which is convenient for assembly.

BRIEF DESCRIPTION OF THE DRAWINGS

The accompanying drawings described here are intended to provide a further understanding of the present disclosure and form a part of the present disclosure. The schematic embodiments and explanations of the present disclosure are configured to explain the present disclosure and do not constitute an improper limitation of the present disclosure.

Figure 1:
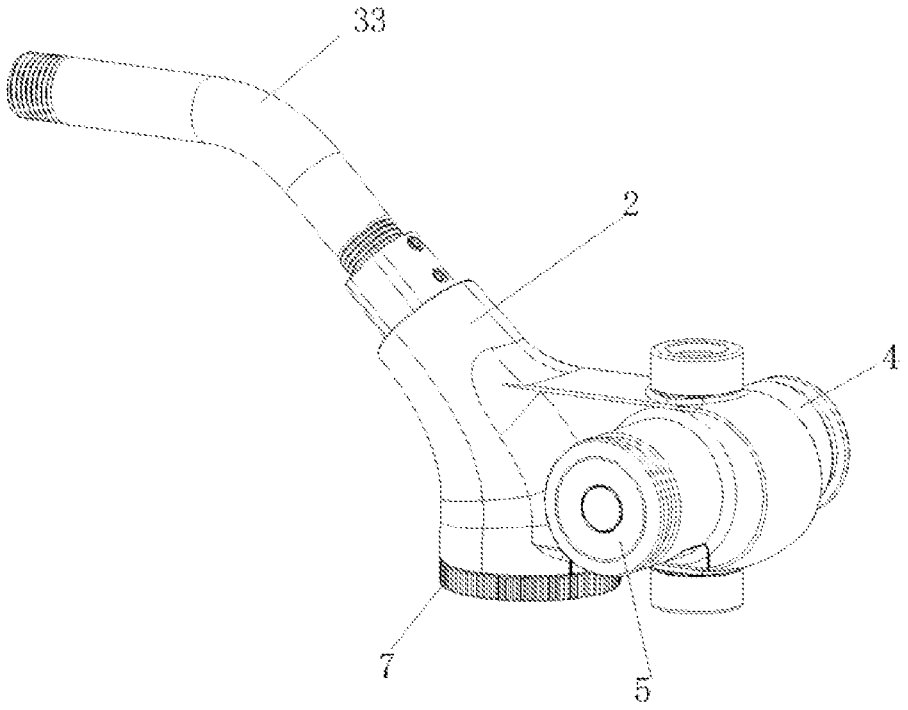
FIG. 1 shows an axial side view of a water supply shower body.
Figure 2:
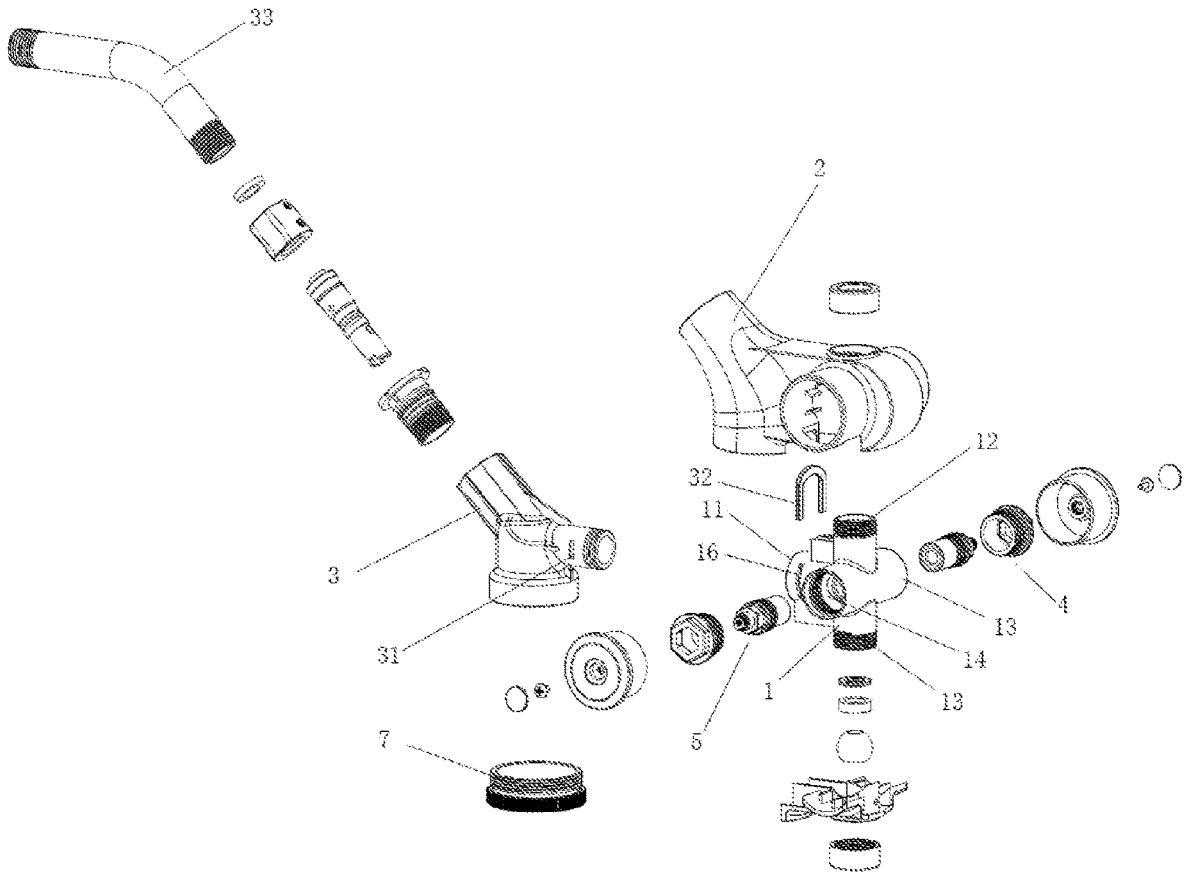
FIG. 2 shows an exploded view of the water supply shower body.
Figure 3:
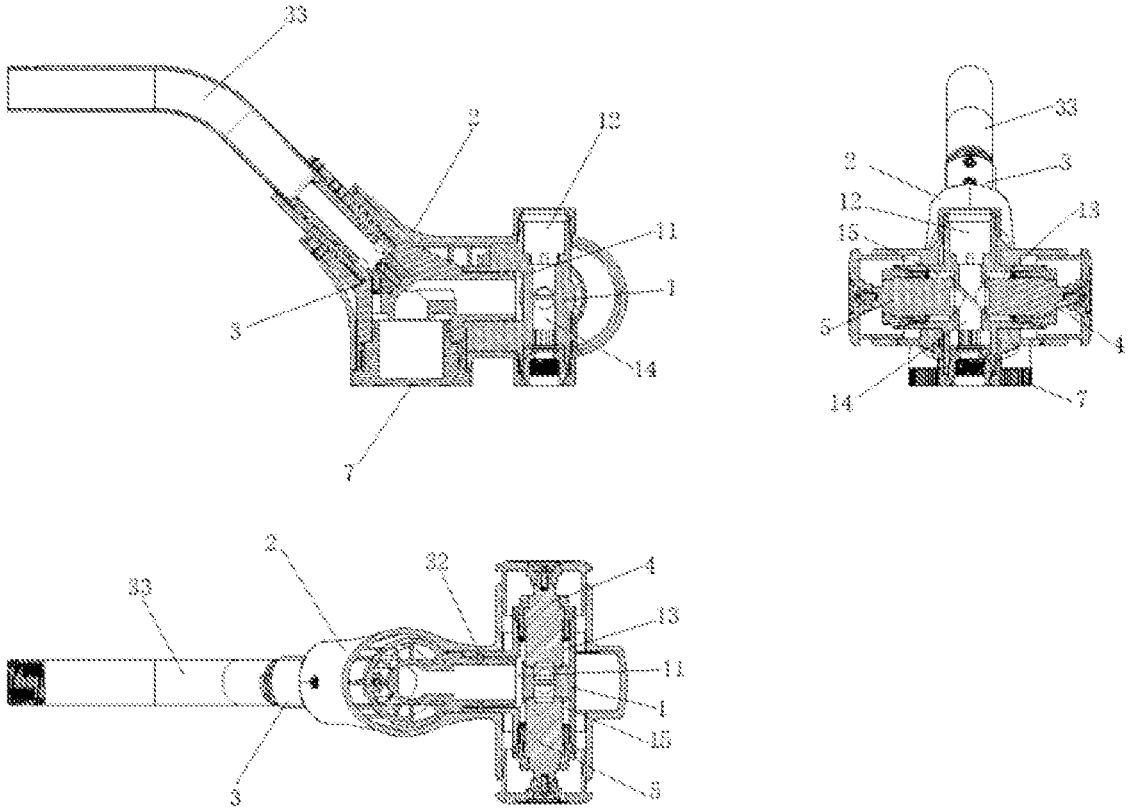
FIG. 3 shows cross-sectional views of the water supply shower body in various directions.
Figure 4:
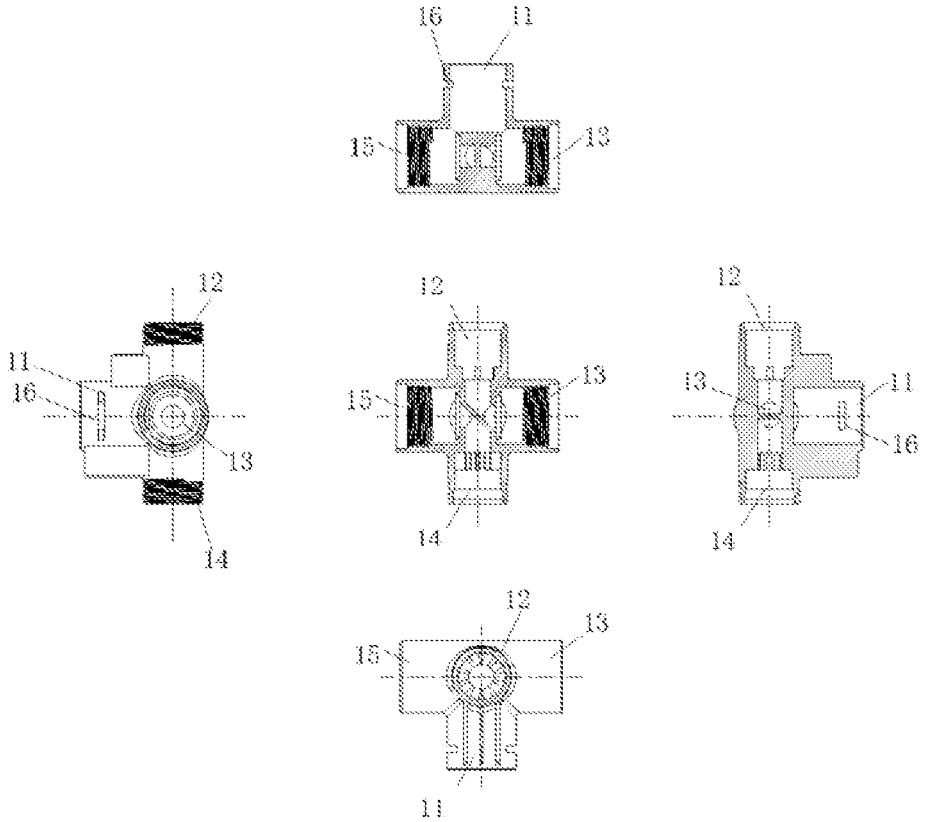
FIG. 4 shows views and cross-sectional views of a five-way water distribution base in various directions.
Figure 5:
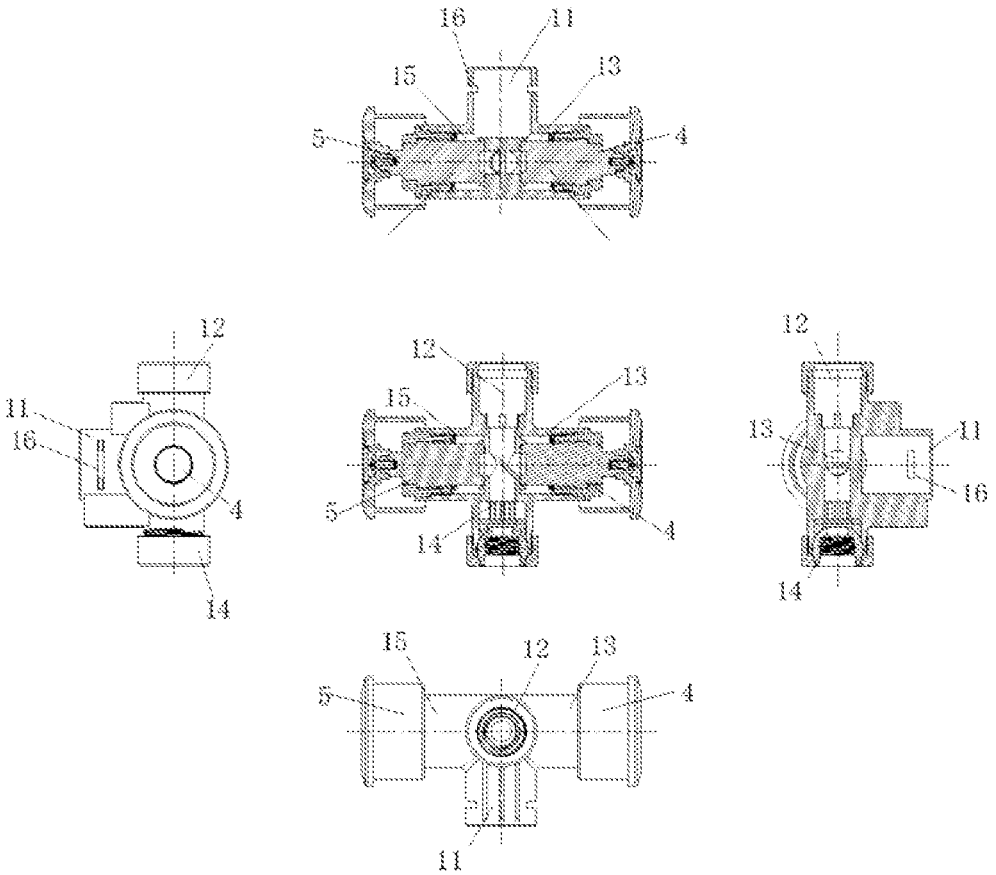
FIG. 5 shows views and cross-sectional views illustrating an on/off valve assembly installed on the five-way water distribution base in various directions.
Figure 6:
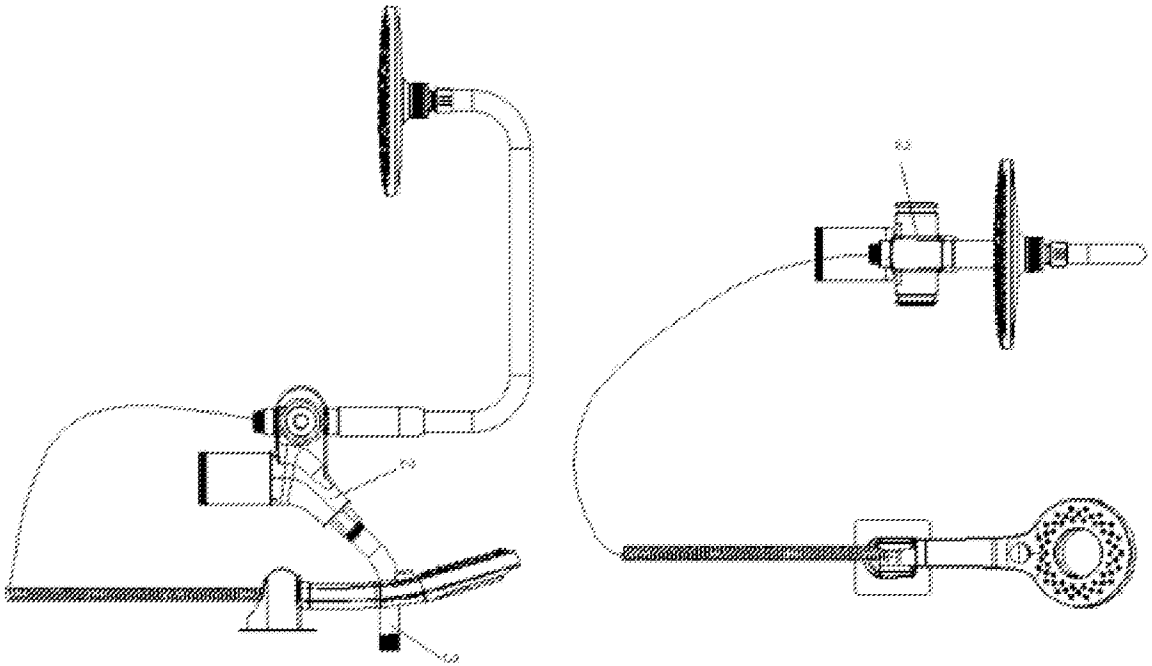
FIG. 6 shows a first application scenario of the water supply shower body.
Figure 7:
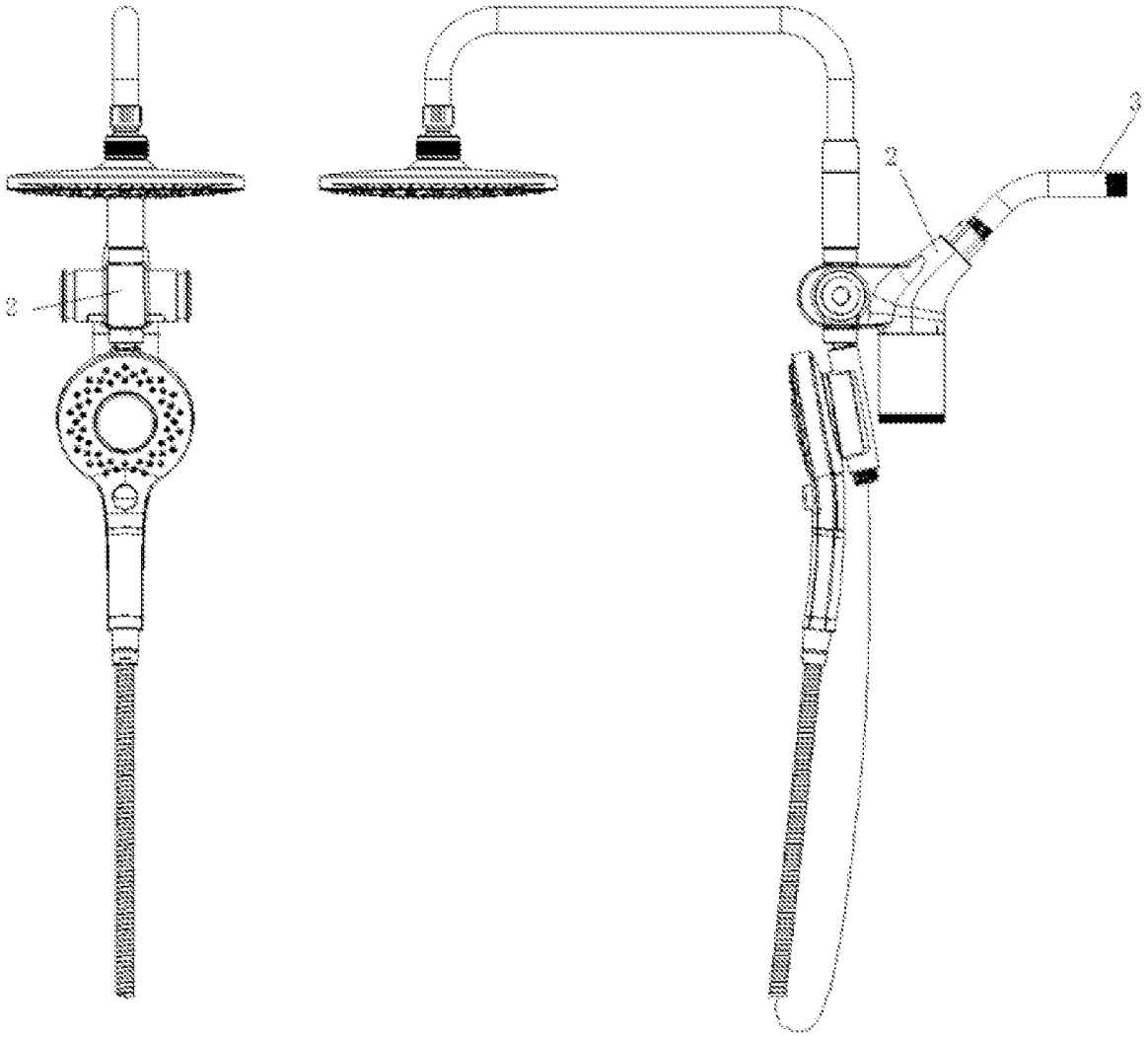
FIG. 7 shows a second application scenario of the water supply shower body.
Figure 8:
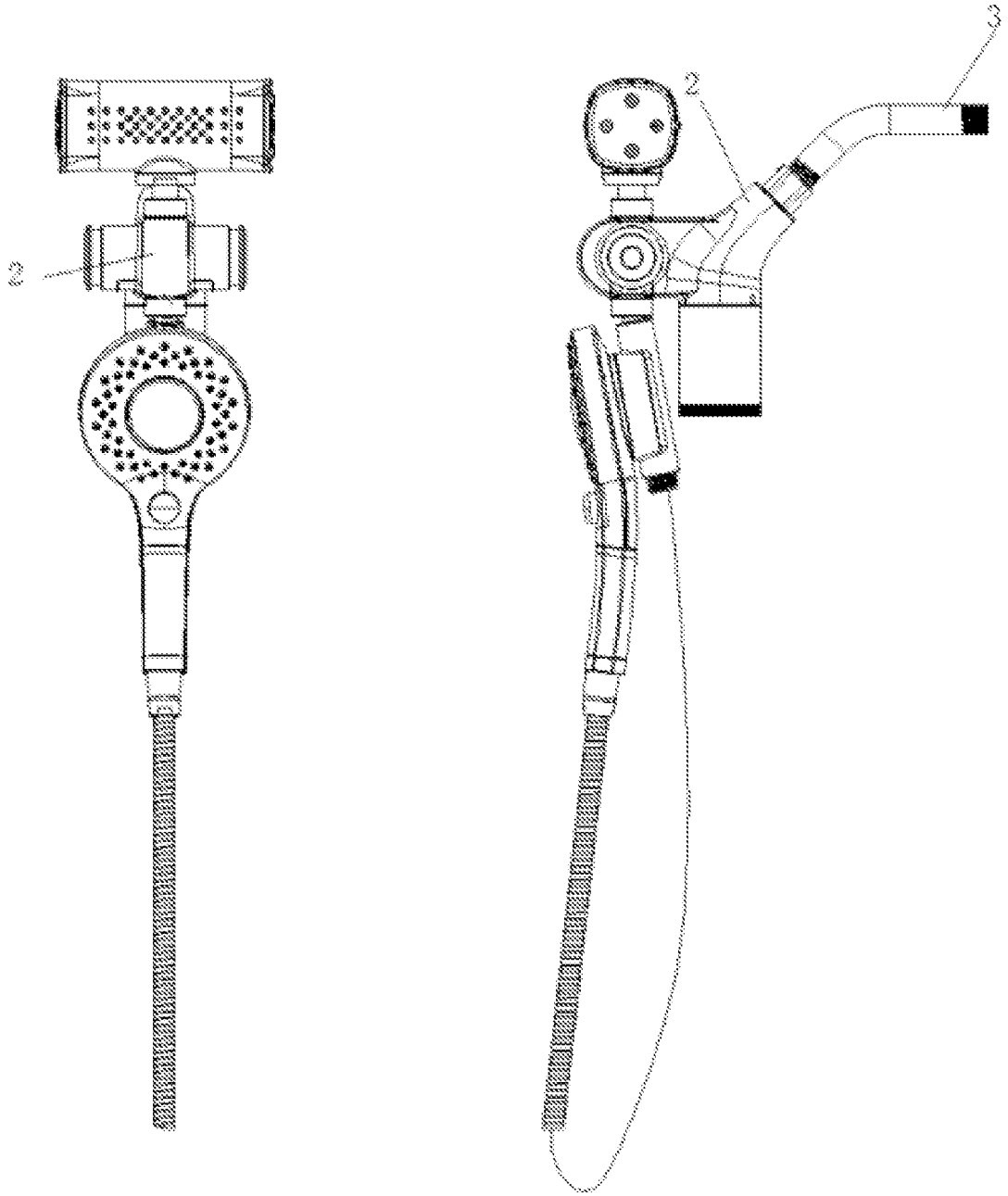
FIG. 8 shows a third application scenario of the water supply shower body.
Figure 9:
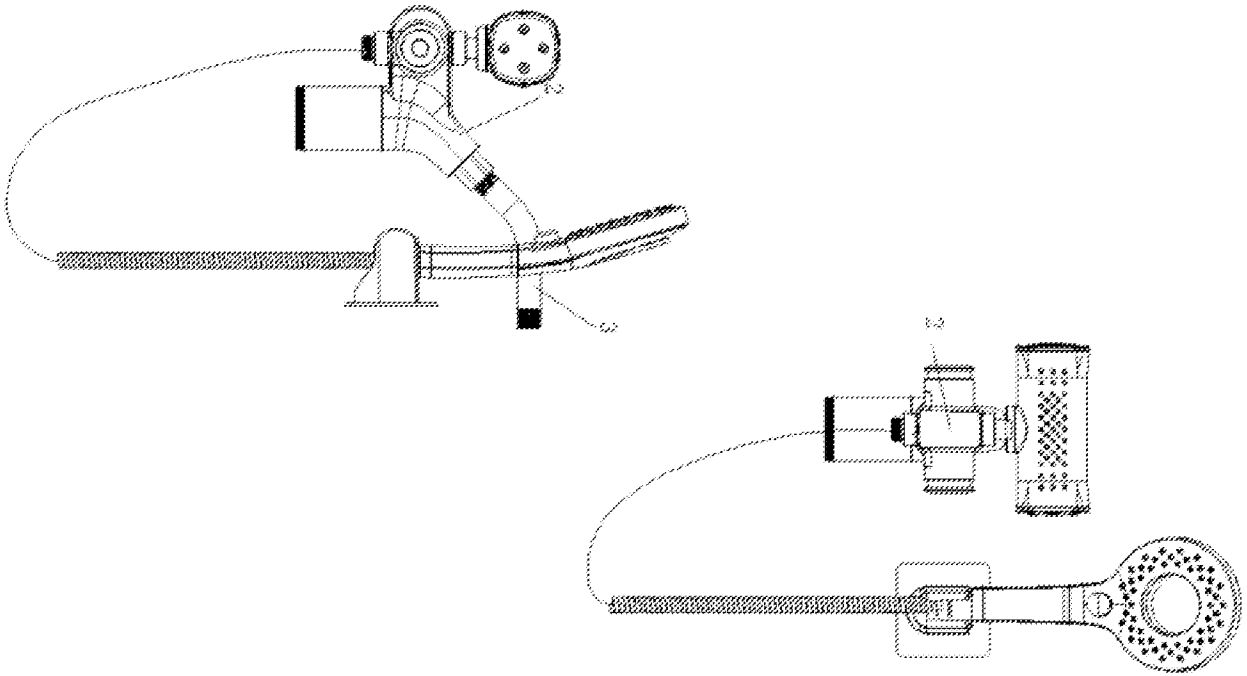
FIG. 9 shows a fourth application scenario of the water supply shower body.
Figure 10:
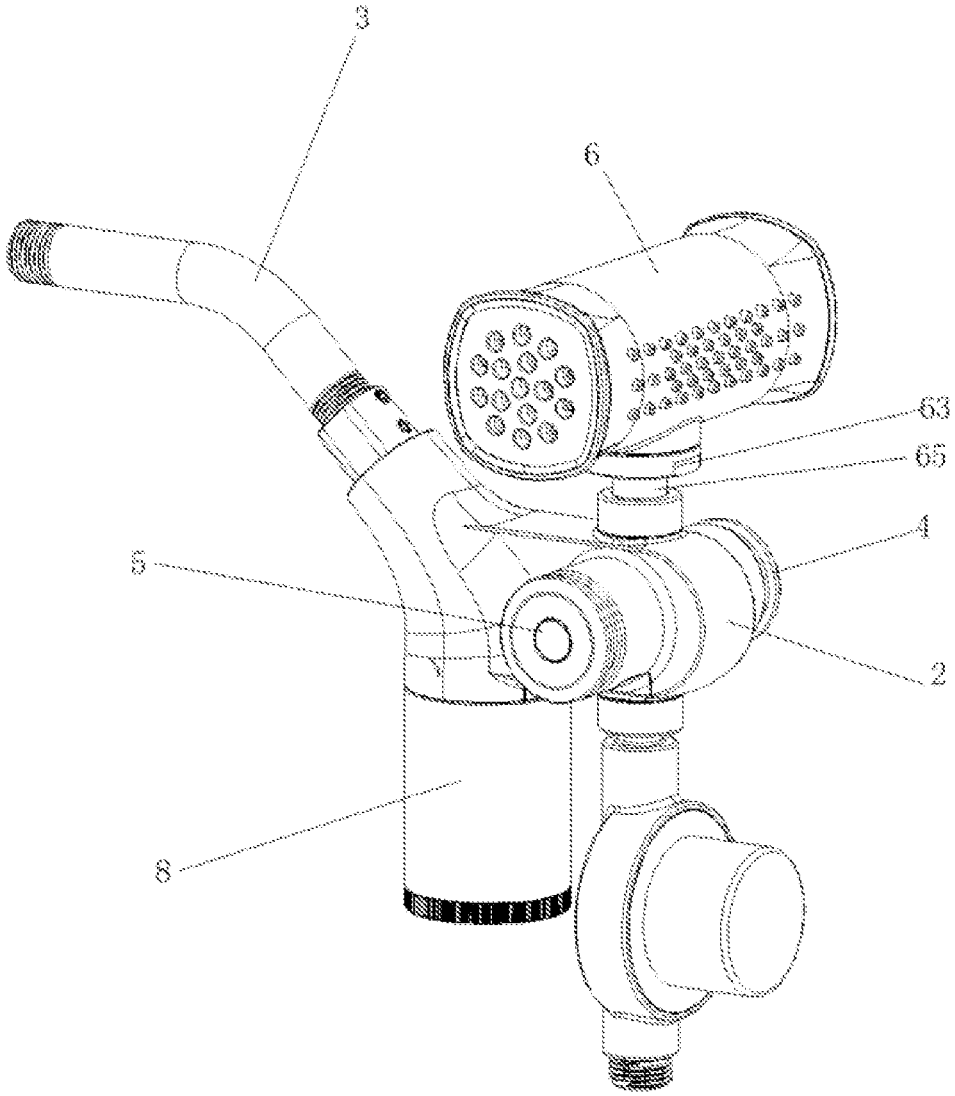
FIG. 10 shows an axial side view of a shower.
Figure 11:
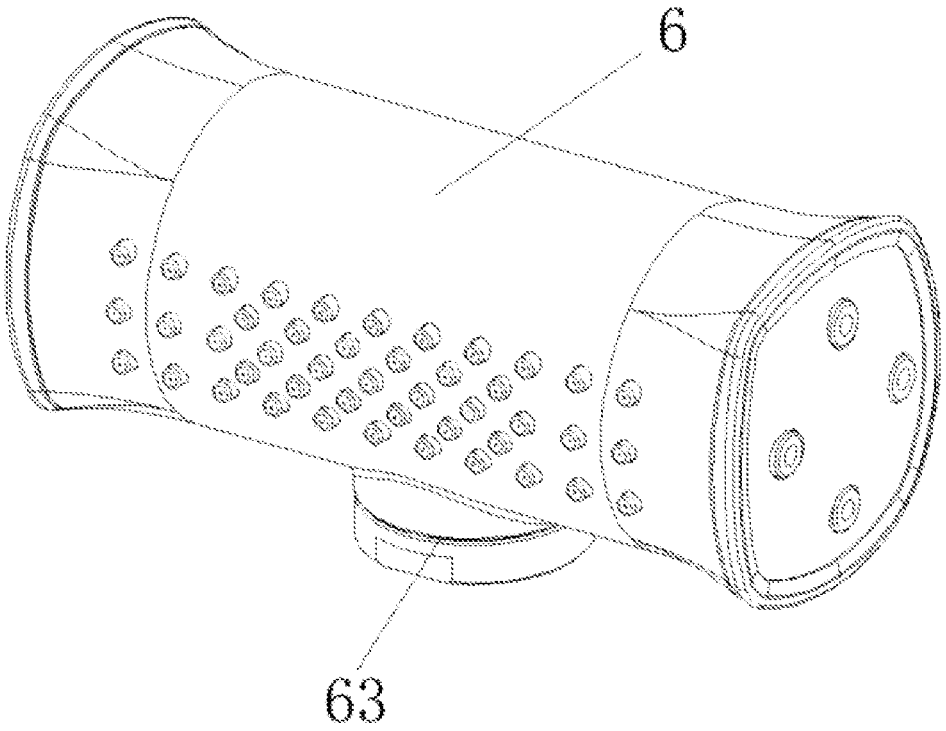
FIG. 11 shows an axial side view of a water outlet element.
Figure 12:
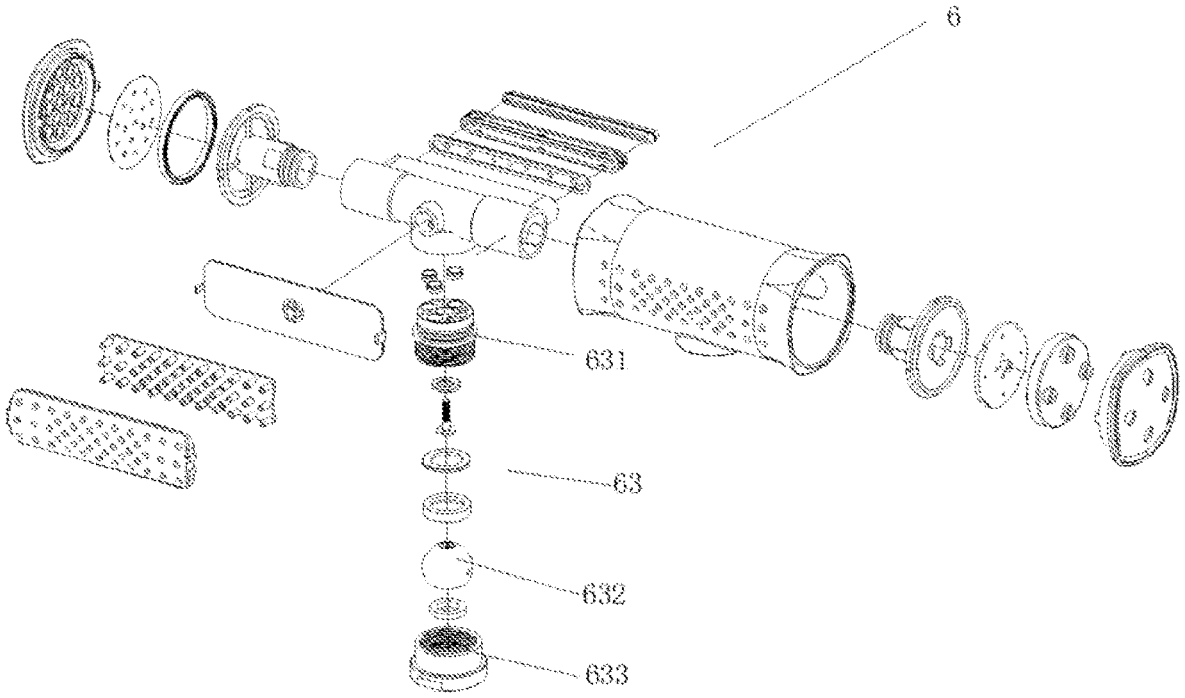
FIG. 12 shows an exploded view of the water outlet element.
Figure 13:
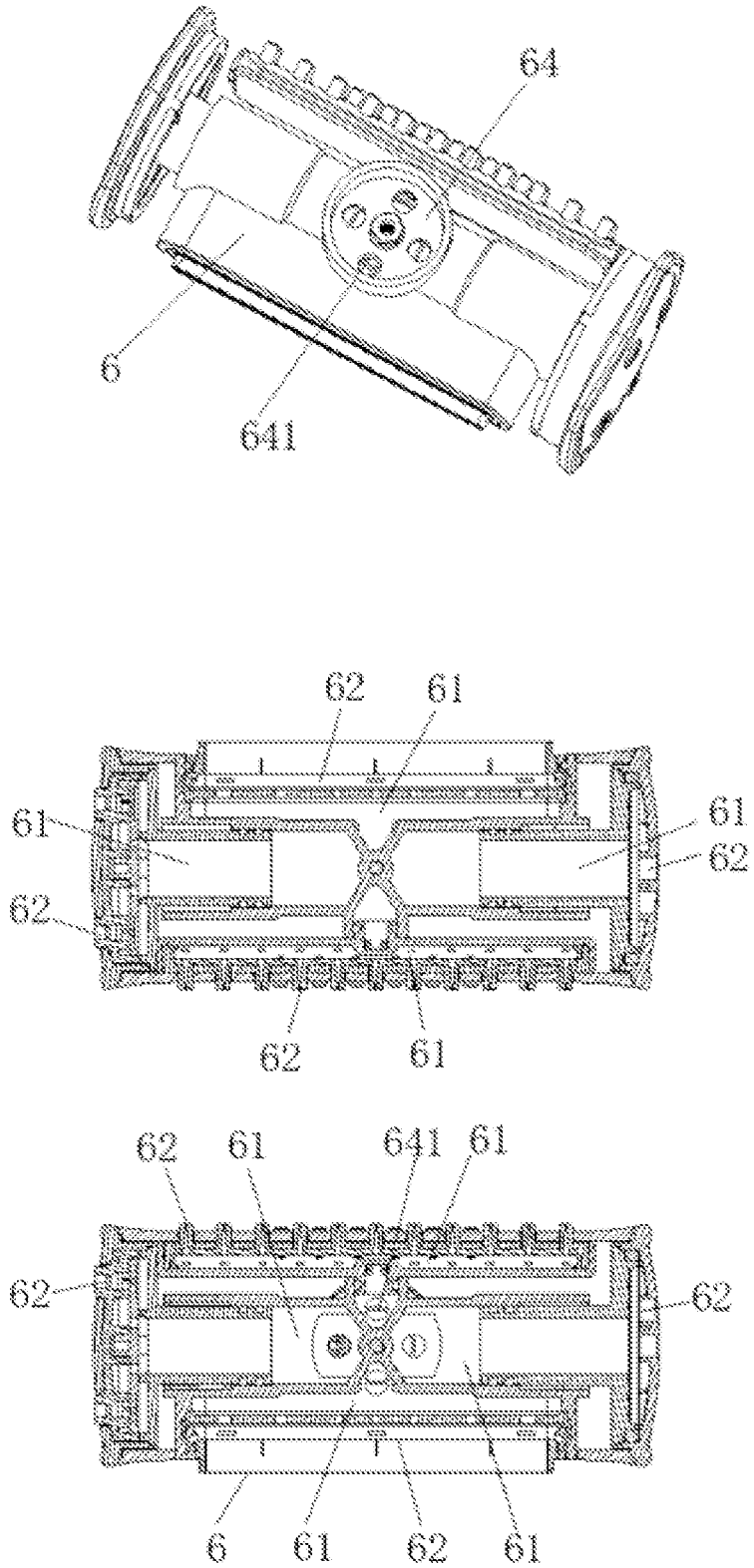
FIG. 13 shows an axial side view and cross-sectional views at different angles of a water outlet body of the water outlet element.
Figure 14:
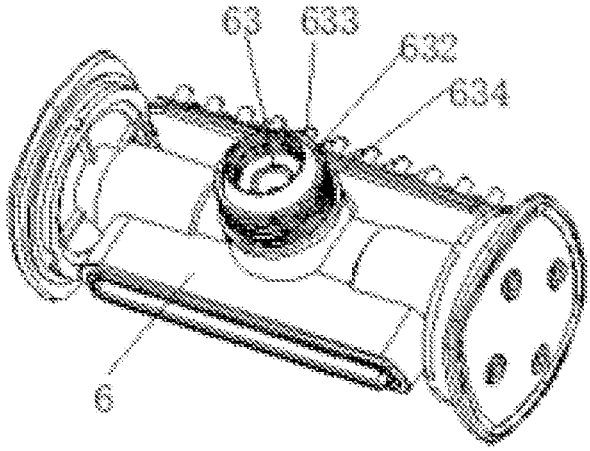
FIG. 14 shows an axial side view and cross-sectional views at different angles of the water outlet body of the water outlet element after installing a rotary switching joint.
Figure 14:
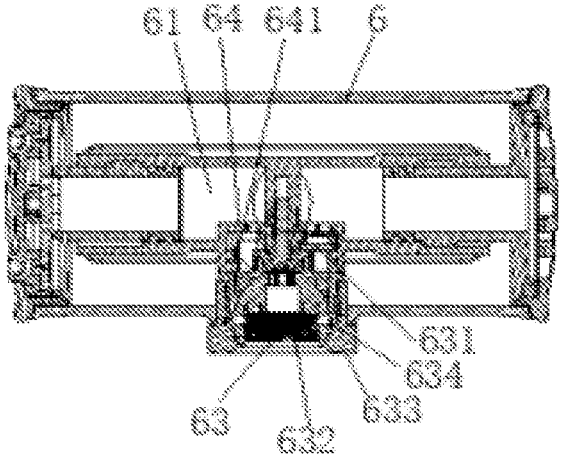
Figure 14:
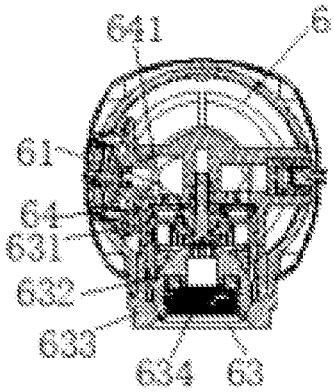

Explanation of reference signs in FIG. 1 to FIG. 17: 1—five-way water distribution base; 11—water inlet; 12—first water outlet; 13—first installation port; 14—second water outlet; 15—second installation port; 16—strip hole; 2—installation base; 3—water inlet base; 31—strip groove; 32—U-shaped fastener; 33—support arm; 34—water outlet groove; 4—first switch valve assembly; 5—second switch valve assembly; 6—water outlet element; 61—water outlet channel; 62—water outlet hole; 63—rotary switching joint; 631—water distribution body; 632—ball head; 633—fixed nut; 634—pin; 64—installation groove; 641—water distribution hole; 65—connecting rod; 7—plug; 8—filter; 81—guiding slope.

DETAILED DESCRIPTION

In order to make the technical problems, technical solutions, and beneficial effects to be solved by the present disclosure clearer, the present disclosure may be further explained in detail in conjunction with the accompanying drawings and embodiments. It should be understood that the specific embodiments described here are only intended to explain the present disclosure and are not intended to limit the present disclosure.

Example 1

Referring to FIGS. 1 to 5, a water supply shower body includes a five-way water distribution base 1, an installation base 2, a water inlet base 3, a first switch valve assembly 4, and a second switch valve assembly 5.

The five-way water distribution base 1 is provided with five ports, namely a water inlet 11, a first water outlet 12, a first installation port 13, a second water outlet 14, and a second installation port 15. Both the first installation port 13 and the second installation port 15 are communicated with the water inlet 11. The first installation port 13 and the second installation port 15 are respectively communicated with the first water outlet 12 and the second water outlet 14. For example, in this embodiment, there is a first water inlet hole between the first installation port 13 and the water inlet 11, and there is a first water outlet hole between the first installation port 13 and the first water outlet 12. A second water inlet hole is arranged between the second installation port 15 and the water inlet 11, and a second water outlet hole is arranged between the second installation port 15 and the second water outlet 14. In addition, to facilitate the installation of the water outlet device, in another embodiment, the water inlet 11 is located on the back of the five-way water distribution base 1, and the first water outlet 12 and the second water outlet 14 are respectively located at the upper end and lower end of the five-way water distribution base 1. As shown in FIGS. 6 to 9, the first water outlet 12 may be provided with a top spray or a water outlet element 6, while the second water outlet 14 may be provided with a sprinkler. The first installation port 13 and the second installation port 15 are respectively located on both sides of the five-way water distribution base 1.

The five-way water distribution base 1 is installed inside the installation base 2. The five-way water distribution base 1 is provided with five openings that correspond to the five ports of the installation base 2. One end of the water inlet base 3 is installed on the installation base 2 and is provided with a water outlet end that is connected to the water inlet 11. In this embodiment, the installation base 2 is in a shell shape, the installation base 2 includes an upper shell and a lower shell to cover the water outlet end of the water inlet base 3 and the five-way water distribution base 1. In another embodiment, an outer circumference of the water inlet 11 of the five-way water distribution base 1 is provided with two symmetrical strip holes 16, and the strip holes 16 are perpendicular to the axial direction of the water inlet 11. The water outlet end of the water inlet base 3 is inserted into the water inlet 11 of the five-way water distribution base 1, and two strip grooves 31 are arranged corresponding to the two strip holes 16. A U-shaped fastener 32 is sleeved on the outer circumference of the water inlet 11 of the five-way water distribution base 1, and two ends of the U-shaped fastener 32 are respectively clamped into the strip grooves 31 through the strip holes 16.

The other end of the water inlet base 3 is provided with a water inlet end, which may supply water to the five-way water distribution base 1. In this embodiment, the water inlet end of the water inlet base 3 adopts a structure of a support arm 33, and the support arm 33 is tilted upwards and the end of the support arm 33 is horizontally arranged to connect with the outlet pipe on the wall.

The first switch valve assembly 4 is installed in the first installation port 13, and the water inlet 11 and the first water outlet 12 are connected/disconnected through the first switch valve assembly 4. The second switch valve assembly 5 is installed in the second installation port 15, and the water inlet 11 and the second water outlet 14 are connected/disconnected through the second switch valve assembly 5.

In one embodiment, both the first switch valve assembly 4 and the second switch valve assembly 5 adopt a press switching structure, which is easy to use. In one embodiment, the first switch valve assembly 4 includes a first button valve core and a first button. The first button valve core is installed in the first installation port 13. One end of the first button is connected to the button valve core, while the other end of the first button extends out of the installation base 2. The second switch valve assembly 5 includes a second button valve core and a second button. The second button valve core is installed in the second installation port 15. One end of the second button is connected to the button valve core, while the other end of the second button extends out of the installation base 2.

When in use, a user may open/close the first water outlet 12 through the first switch valve assembly 4, and may open/close the second water outlet 14 through the second switch valve assembly 5. In addition, the switches of the two water outlets may be operated independently. That is, the switches of the two water outlets may be opened individually, or simultaneously.

In the present disclosure, the five-way water distribution base 1 is disposed, to achieve the independent setting of control switches for two water outlets, thereby avoiding inconvenience to the user when four gears are concentrated on one switch.

Example 2

Referring to FIGS. 10 to 14, a shower includes a water outlet element 6 and a water supply shower body as described in Example 1. The water outlet element 6 is provided with at least two water outlet channels 61 and corresponding at least two water outlet holes 62. The water outlet element 6 is provided with a rotary switching joint 63. The water outlet element 6 is rotatably installed at the first water outlet 12 of the water supply shower body through the rotary switching joint 63. The first water outlet 12 is communicated with any one of the at least two water outlet channels 61 and the at least two water outlet holes 62 through the rotary switching joint 63.

In one embodiment, the water outlet element 6 is provided with an installation groove 64, and the bottom of the installation groove 64 is provided with a plurality of water distribution hole 641 that is communicated with a plurality of water inlet channels one by one. The rotary switching joint 63 is provided with a water distribution body 631, the water distribution body 631 is provided with a water outlet passage. The water distribution body 631 is rotatably installed in the installation groove 64, and the other end is fixedly installed relative to the first water outlet 12 of the water supply shower body. When in use, by rotating the water outlet element 6, it is possible to drive the relative rotation between the rotary switching joint 63 and the water outlet channel 61, thereby achieving changes in the switching water path and water outlet status, which is convenient to use and brings a different user experience. In this embodiment, the water outlet channel 61 and the water outlet holes 62 have four groups, which are respectively located on the four surfaces of the water outlet element 6. That is, the water outlet element 6 has four types of outlet water sprays, including sprinkler water, granular water, waterfall water, and high-pressure water.

In another embodiment, in order to improve the flexibility of the water outlet element 6 and make it more suitable for the users of various heights, the rotary switching joint 63 further includes a swing joint.

A connecting channel is defined in the internal of the swing joint, and is communicated with the water outlet passage and the first water outlet 12. The swing axis of the swing joint is perpendicular to the rotation axis of the water distribution body 631, so that the water outlet element 6 may swing up and down through the swing joint without affecting the rotation switching function. In this embodiment, the swing joint is a ball head 632 with a pin hole, the connecting channel is communicated with the ball head 632, and the pin hole is perpendicular to the rotation axis of the water distribution body 631. The rotary switching joint 63 further includes a fixing nut 633 and a pin 634. The water distribution body 631 is installed in the installation groove 64 through screw rotation. The water inlet end of the water distribution body 631 is provided with a bowl-shaped groove, and two symmetrical notches are arranged on both sides of the bowl-shaped groove. The fixing nut 633 presses and installs the ball head 632 on the bowl-shaped groove. The pin 634 penetrates the ball head 632 through the pin hole, and both ends of the pin 634 rotate and snap into the gap. The water inlet end of the ball head 632 is connected to the first water outlet 12 of the water supply shower body through a connecting rod 65.

Example 3

Figure 15:
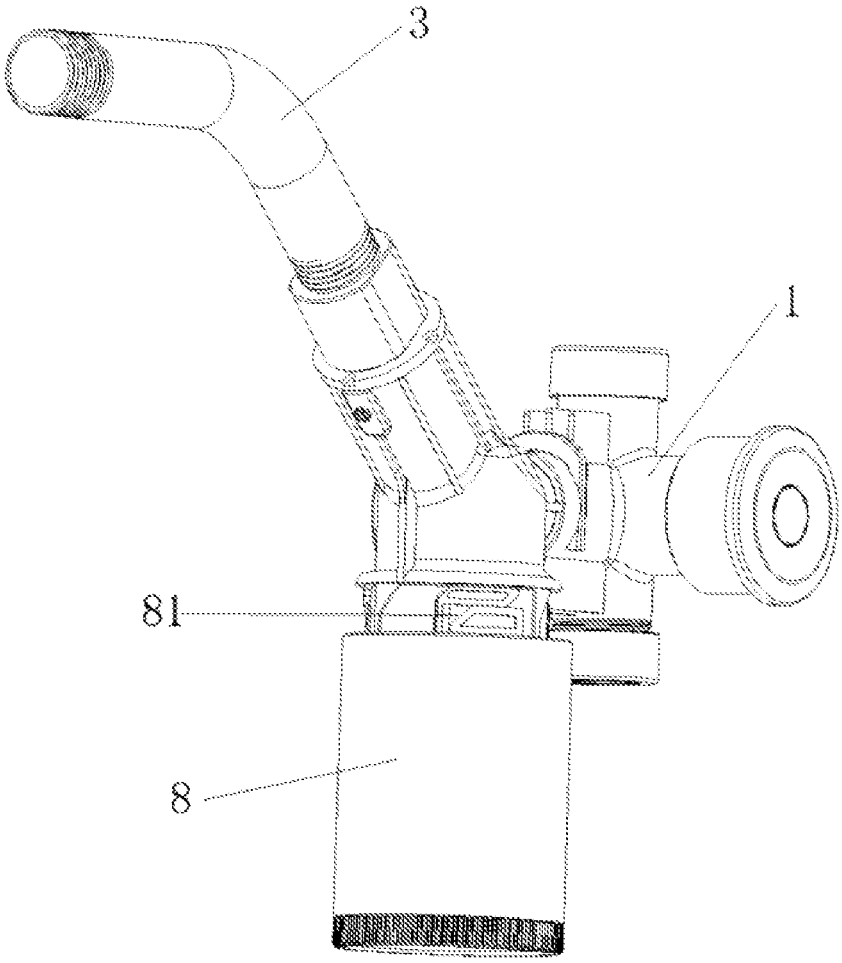
FIG. 15 shows an axial side view of a water supply shower.
Figure 16:
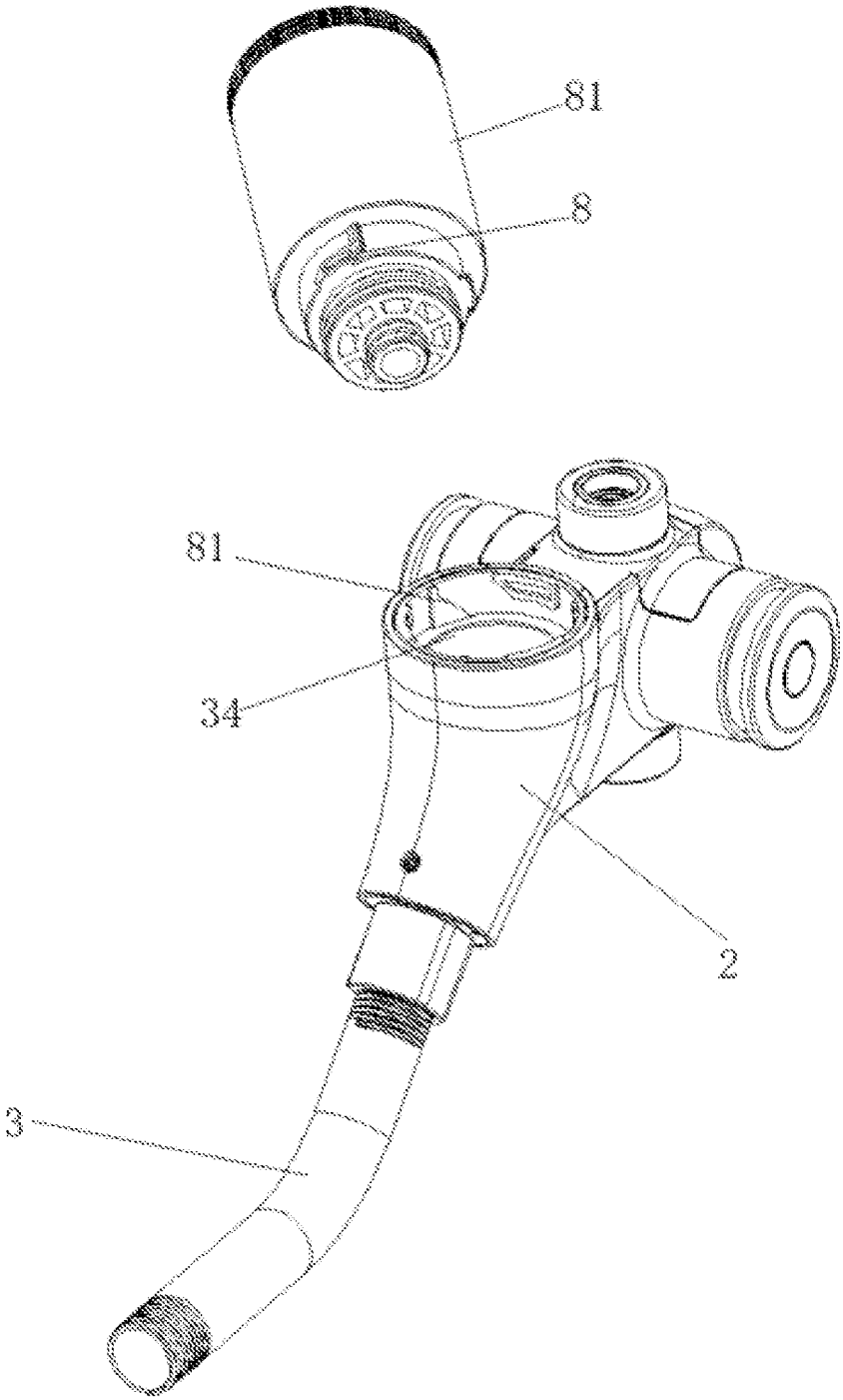
FIG. 16 shows an axial side view of the water supply shower when a filter in removed state.
Figure 17:
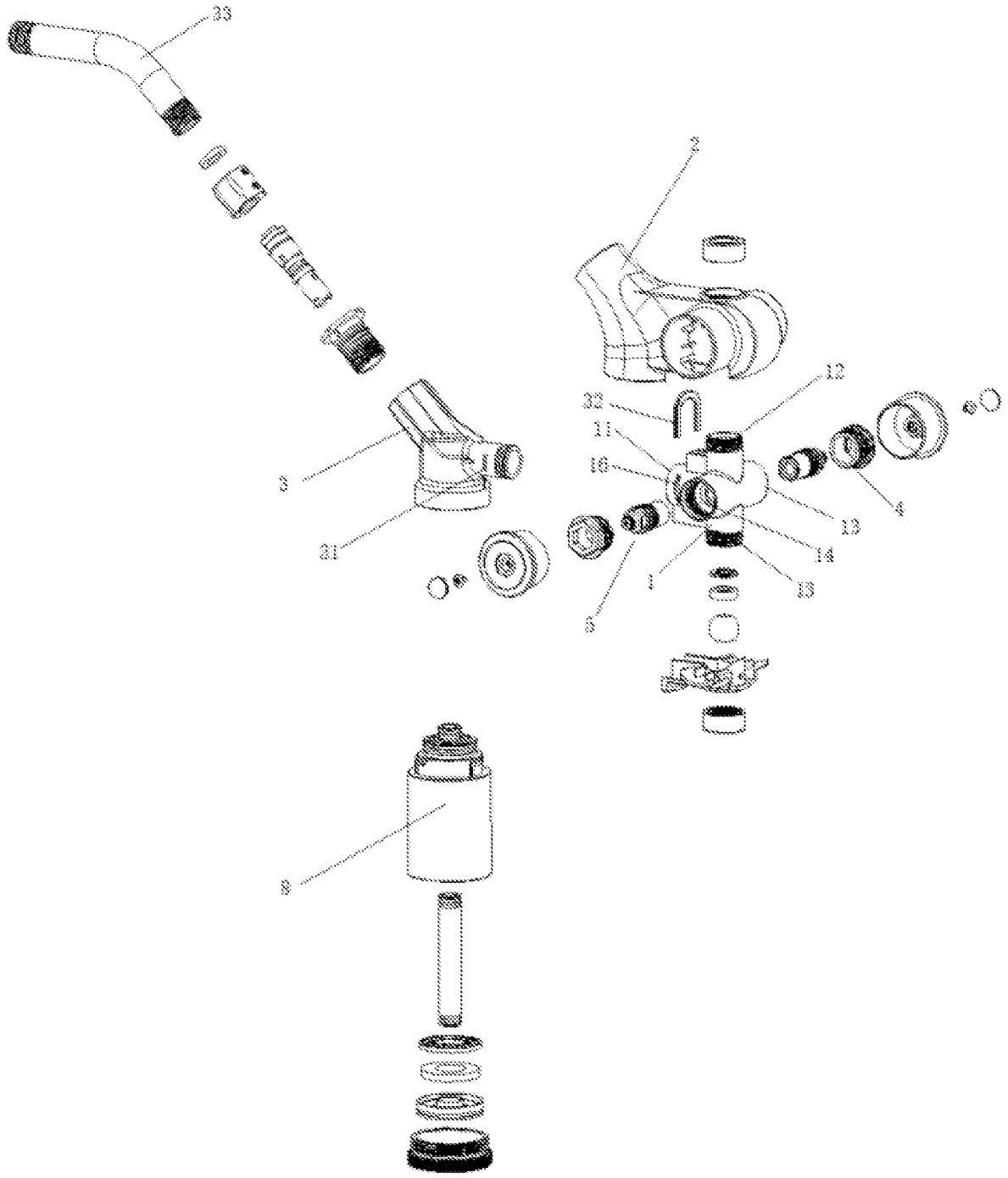
FIG. 17 shows an exploded view of the water supply shower.

Referring to FIGS. 15 to 17, a water supply shower adopts the water supply shower body as described in Example 1. The water inlet base 3 is provided with a water outlet groove 34. The water outlet groove 34 is communicated with the water inlet end and the water outlet end through a water supply hole and a drainage hole, respectively. An opening of the water outlet groove 34 is provided with a plug 7 or a filter 8. The water filtering channel of the filter 8 is respectively connected to the water supply hole and the drainage hole. That is, the plug 7 and filter 8 may be replaced, thereby achieving that the water supply shower may use the filter 8 to filter water or not.

In one embodiment, the plug 7 or the filter 8 is assembled with the water outlet groove 34 by using a staggered rotating structure. The head circumference of the plug 7 and the filter 8 is provided with a rotating docking convex block. The opening circumference of the water outlet groove 34 is provided with a circular rotating docking groove. The side of the rotating docking convex block and the starting wall surface of the rotating docking groove are both provided with corresponding guiding slopes 81 for convenient docking operations.

In one embodiment, the water supply shower may achieve four functions; first, releasing water from the sprinkler; second, releasing water from the top spray; third, releasing water from the sprinkler and releasing water from the top spray; fourth, cutting off the water supply. In addition, the above water outlet function may be switched to a water outlet mode with the filter 8. That is, without using the filter 8 to discharge filtered water.

The above exemplary description of the present disclosure is provided in conjunction with the accompanying drawings. It is evident that the specific implementation of the present disclosure is not limited by the aforementioned modes. As long as various non substantial improvements are made using the method concept and technical solutions of the present disclosure, or when the concept and technical solutions of the present disclosure are directly applied to other occasions without improvement, they are all within the scope of protection of the present disclosure.

What is claimed is:

1. A water supply shower body, comprising:

a five-way water distribution base;

an installation base;

a water inlet base;

a first switch valve assembly; and a second switch valve assembly;

wherein the five-way water distribution base is provided with five ports, namely a water inlet, a first water outlet, a first installation port, a second water outlet, and a second installation port; and both the first installation port and the second installation port are communicated with the water inlet, and the first installation port and the second installation port are respectively communicated with the first water outlet and the second water outlet;

the five-way water distribution base is installed inside the installation base; and the installation base is provided with five openings that correspond to the five ports of the five-way water distribution base;

one end of the water inlet base is installed on the installation base and is provided with a water outlet end that is connected to the water inlet, and the other end of the water inlet base is provided with a water inlet end; and the first switch valve assembly is installed in the first installation port, and the water inlet and the first water outlet are connected/disconnected through the first switch valve assembly; and the second switch valve assembly is installed in the second installation port, and the water inlet and second water outlet are connected/disconnected through the second switch valve assembly.

2. The water supply shower body according to claim 1, wherein the water inlet end of the water inlet base adopts a support arm structure, the support arm is tilted upwards, and an end of the support arm is horizontally arranged.

3. The water supply shower body according to claim 1, wherein an outer circumference of the water inlet of the five-way water distribution base is provided with symmetrical two strip holes, and the two strip holes are perpendicular to an axial direction of the water inlet; the water outlet end of the water inlet base is inserted into the water inlet of the five-way water distribution base, and two strip grooves are arranged corresponding to the two strip holes; and a U-shaped fastener is sleeved on the outer circumference of the water inlet of the five-way water distribution base, and two ends of the U-shaped fastener are respectively clamped into the two strip grooves through the strip holes.

4. The water supply shower body according to claim 1, wherein the installation base is shell shaped and covers the water outlet end of the water inlet base and the five-way water distribution base.

5. The water supply shower body according to claim 1, wherein each of the first switch valve assembly and a second switch valve assembly adopts a press switch structure.

6. The water supply shower body according to claim 5, wherein the first switch valve assembly comprises a first button valve core and a first button, the first button valve core is installed in the first installation port, one end of the first button is connected to the button valve core, and the other end of the first button extends out of the installation base; and the second switch valve assembly comprises a second button valve core and a second button, the second button valve core is installed in the second installation port, one end of the second button is connected to the button valve core, and the other end of the second button extends out of the installation base.

7. The water supply shower body according to claim 1, wherein a first water inlet hole is defined between the first installation port and the water inlet, and a first water outlet hole is defined between the first installation port and the first water outlet; and a second water inlet hole is defined between the second installation port and the water inlet, and a second water outlet hole is defined between the second installation port and the second water outlet.

8. The water supply shower body according to claim 1, wherein the water inlet is located on a back of the five-way water distribution base, and the first water outlet and the second water outlet are respectively located on an upper end and a lower end of the five-way water distribution base; and the first installation port and the second installation port are respectively located on two sides of the five-way water distribution base.

9. The water supply shower body according to claim 8, wherein the first water outlet is connected to a top spray, and the second water outlet is connected to a sprinkler.

10. A shower, comprising:

a water outlet element; and a water supply shower body of claim 1;

wherein the water outlet element is provided with at least two water outlet channels and corresponding at least two water outlet holes, the water outlet element is provided with a rotary switching joint, the water outlet element is rotatably installed at the first water outlet of the water supply shower body through the rotary switching joint, and the first water outlet is communicated with any one of the at least two water outlet channels and the at least two water outlet holes through the rotary switching joint.

11. The shower according to claim 10, wherein the water outlet element is provided with an installation groove, and a bottom of the installation groove is provided with a plurality of water distribution hole that is communicated with a plurality of water inlet channels one by one;

the rotary switching joint is provided with a water distribution body, and the water distribution body is provided with a water outlet passage; and the water distribution body is rotatably installed in the installation groove, and the other end is fixedly installed relative to the first water outlet of the water supply shower body.

12. The shower according to claim 11, wherein the rotary switching joint further comprises a swing joint, a connecting channel is defined in an internal of the swing joint and is communicated with the water outlet passage and the first water outlet, and a swing axis of the swing joint is perpendicular to a rotation axis of the water distribution body.

13. The shower according to claim 12, wherein the swing joint is a ball head with a pin hole, the connecting channel is communicated with the ball head, and the pin hole is perpendicular to the rotation axis of the water distribution body; the rotary switching joint further comprises a fixing nut and a pin; and the water distribution body is installed in the installation groove through screw rotation; a water inlet end of the water distribution body is provided with a bowl-shaped groove, and two symmetrical notches are arranged on two sides of the bowl-shaped groove; the fixing nut presses and installs the ball head on the bowl-shaped groove; the pin penetrates the ball head through the pin hole, and two ends of the pin rotate and snap into a gap;

and the water inlet end of the ball head is connected to the first water outlet of the water supply shower body through a connecting rod.

14. The shower according to claim 10, wherein the at least two water outlet channels and the at least two water outlet holes have four groups, which are respectively located on four surfaces of the water outlet element.

15. A water supply shower, comprising:

the water supply shower body of claim 1;

wherein the water inlet base is provided with a water outlet groove, and the water outlet groove is respectively communicated with the water inlet end and water outlet end through a water supply hole and a drainage hole; and an opening of the water outlet groove is installed with a plug or a filter, and a filtering channel of the filter is respectively connected to the water supply hole and the drainage hole.

16. The water supply shower according to claim 15, wherein the plug or the filter is assembled with the water outlet groove by using a staggered rotating structure, a head circumference of the plug or the filter is provided with a rotating docking convex block, an opening circumference of the water outlet groove is provided with a circular rotating docking groove, and a side of the rotating docking convex block and a starting wall surface of the rotating docking groove are provided with corresponding guiding slopes.

* * * * *